US009488320B1

(12) United States Patent
Palfreyman et al.

(10) Patent No.: US 9,488,320 B1
(45) Date of Patent: Nov. 8, 2016

(54) SHIPPABLE LED-BASED LUMINAIRE

(71) Applicants: Paul Palfreyman, Vancouver (CA); Andrew Tien-Man Ng, Vancouver (CA); Michael A. Tischler, Vancouver (CA)

(72) Inventors: Paul Palfreyman, Vancouver (CA); Andrew Tien-Man Ng, Vancouver (CA); Michael A. Tischler, Vancouver (CA)

(73) Assignee: COOLEDGE LIGHTING INC., Richmond (CA)

( * ) Notice: Subject to any disclaimer, the term of this patent is extended or adjusted under 35 U.S.C. 154(b) by 261 days.

(21) Appl. No.: 14/471,406

(22) Filed: Aug. 28, 2014

(51) Int. Cl.

| | |
|---|---|
| ***H01R 33/00*** | (2006.01) |
| ***F21K 99/00*** | (2016.01) |
| ***H05B 33/08*** | (2006.01) |
| ***F21V 23/02*** | (2006.01) |

(52) U.S. Cl.
CPC ..... *F21K 9/00* (2013.01); *F21V 23/02* (2013.01); *H05B 33/0821* (2013.01)

(58) Field of Classification Search
CPC ..... H01L 25/00; F21Y 2101/00; F21S 2/00; F21K 9/00; H05B 33/0821; F21V 23/02
USPC ..... 362/640, 249.02, 249.08
See application file for complete search history.

(56) References Cited

U.S. PATENT DOCUMENTS

| | | | | |
|---|---|---|---|---|
| 2010/0065873 | A1* | 3/2010 | Bhattacharya | A41D 27/085 257/98 |
| 2011/0254470 | A1* | 10/2011 | Penoyer | F21S 2/005 315/313 |
| 2014/0191668 | A1* | 7/2014 | Engelen | F21V 23/0492 315/159 |
| 2014/0362566 | A1* | 12/2014 | Tischler | F21V 31/005 362/230 |
| 2014/0369038 | A1* | 12/2014 | Tischler | F21V 21/14 362/235 |

* cited by examiner

*Primary Examiner* — Ali Alavi
(74) *Attorney, Agent, or Firm* — Morgan, Lewis & Bockius LLP

(57) ABSTRACT

In accordance with certain embodiments, lighting systems include a set of components that fit entirely within a shipping container that interfits with at least some of the components to form the assembled lighting system.

22 Claims, 8 Drawing Sheets

SHIPPABLE LED-BASED LUMINAIRE

FIELD OF THE INVENTION

In various embodiments, the present invention generally relates to illumination devices, and more specifically to LED-based luminaires such as desk lamps.

BACKGROUND

In many lighting applications it is desirable to have lighting systems or luminaires that are lightweight and that may be packaged and shipped easily at relatively low cost. This is particularly important for design and advertising samples, where large numbers of lamps are shipped individually to many different recipients. Such samples also desirably meet certain aesthetic design requirements to highlight the virtues of the illumination source and/or luminaire. In many cases it is difficult to meet both of these requirements because the weight, material, and/or size constraints for low-cost packaging and shipping are at odds with the design of the luminaire.

In view of the foregoing, a need exists for systems and techniques enabling the low-cost design and manufacture of illumination systems combining high-quality design and ease of packing and/or shipping at low cost.

SUMMARY

In accordance with certain embodiments of the present invention, the disassembled components of a lighting system are initially packed and/or shipped in a packaging container that, when the lighting system is assembled, is utilized (in whole or in part) as an integral component of the lighting system. For example, the packaging container (or a portion thereof) may function as the "base" of the lighting system on which the system's light-emitting component(s) are mounted, or the packaging container (or a portion thereof) may function as the "shade" that transmits and/or diffuses the light from the light-emitting component(s). In general, the packing container interfits with at least some of the components to form the assembled lighting system. As utilized herein, "interfitting with" means interlocking with, connecting with, accommodating, supporting (in whole or in part) or being supported by (in whole or in part), receiving, and/or surrounding (in whole or in part) or being surrounded by (in whole or in part).

Thus, in various embodiments, the largest component of the lighting system and/or the component of the lighting system least conducive to being folded or deformed (e.g., the least flexible component) is utilized to contain the other smaller and/or more deformable components prior to assembly of the lighting system. Consequently, lighting systems in accordance with embodiments of the present invention may be safely and compactly shipped and/or handled prior to assembly and yet, after assembly, feature unfolded or unfurled components having a dimension larger than a dimension of the packing container. In addition, because at least part of the packing container is utilized within the assembled lighting system, less waste is produced, and the lighting system may even be completely or partially disassembled and repacked into the packing container for subsequent handling, moving, or shipping.

As mentioned above, various embodiments of the present invention feature lighting systems that are designed to be packaged and/or shipped in a disassembled or partially disassembled form and when assembled, incorporate at least a portion of the container in which the lighting system is packed and/or shipped as part of the assembled lighting system. In some exemplary embodiments of the present invention, the lighting system may include or consist essentially of a flexible light sheet, a power supply and optional controls, a diffuser, and the packing container. The flexible light sheet, power supply, optional controls, and diffuser are contained within the packing container during shipping, and the packing container is utilized as a component of the luminaire during assembly, e.g., as a base or support for the luminaire. In some embodiments, the packing container may also be used as the shipping container or shipping package; however, this is not a limitation of the present invention, and in other embodiments the packing container may be contained within a different shipping container.

Because even the light-emitting components of the lighting system (or the "illumination source(s)") are at least initially packed in the packing container, embodiments of the present invention may advantageously feature as the illumination source light sheets including or consisting essentially of an array of light-emitting elements (LEEs) and one or more control elements electrically coupled by conductive elements formed on a flexible substrate, for example as described in U.S. patent application Ser. No. 13/799,807, filed Mar. 13, 2013 (the '807 application), or U.S. patent application Ser. No. 13/970,027, filed Aug. 19, 2013 (the '027 application), the entire disclosure of each of which is herein hereby incorporated by reference. However, this is not a limitation of the present invention, and in other embodiments the illumination sources may include single rows of LEDs on flexible substrates, for example LED tape light or semi-flexible or rigid printed circuit boards upon which are mounted one or more LEEs. While preferred embodiments of the present invention utilize light-emitting diodes (LEDs) as the LEEs, this is not a limitation of the present invention, and in other embodiments the LEEs may include organic light-emitting diodes (OLEDs), incandescent, fluorescent, halogen, discharge, and/or other types of light-emitting elements.

In an aspect, embodiments of the invention feature a method of assembling a lighting system that includes, consists essentially of, or consists of a set of components initially disposed entirely within a packing container. The set of components includes, consists essentially of, or consists of one or more illumination sources and a power supply. The components are removed from the packing container. An electrical connection between the power supply and the one or more illumination sources is provided. The finished lighting system is assembled by attaching the one or more illumination sources to the packing container such that, when the one or more illumination sources are illuminated, light from the one or more illumination sources is visible to an observer, the packing container physically and stably supporting the one or more illumination sources in the assembled lighting system during operation thereof.

Embodiments of the invention may include one or more of the following in any of a variety of combinations. The electrical connection between the power supply and the one or more illumination sources may be provided within the packing container before the components are removed therefrom (e.g., the power supply may be removably or permanently electrically connected to one or more of the illumination sources as packed within the packing container). Providing the electrical connection between the power supply and the one or more illumination sources may include or consist essentially of connecting a cable (i.e., a conduit, wire, or any other electrical connection) between the power supply and at least one illumination source. One or more (or even all) of the illumination sources may be attached to an exterior surface of the packing container. One or more (or even all) of the illumination sources may be attached to an interior surface of the packing container. One or more of the illumination sources may be attached to each of the interior and exterior surfaces of the packing container. The set of components may include a shade, which may be disposed at least partially around one or more of the illumination sources. The shade may include or consist essentially of a plurality of shade elements. Each shade element may be folded and/or deformed to fit within the packing container prior to removal therefrom. Disposing the shade at least partially around one or more of the illumination sources may include or consist essentially of stacking the shade elements and/or at least partially interlocking the shade elements together. The shade may include, consist essentially of, or consist of polyethylene naphthalate, polyethylene terephthalate, polycarbonate, polyethersulfone, polyester, polyimide, polyethylene, fiberglass, FR4, fabric, rubber, paper, glass, and/or cardboard. At least a portion of the shade may have a transmittance greater than 25% to a wavelength of light emitted by the one or more illumination sources. At least a portion of an interior surface of the shade and/or at least a portion of an exterior surface of the shade may have a reflectance greater than 50% to a wavelength of light emitted by the one or more illumination sources.

The set of components may include a controller that is electrically connected to at least one of the power supply or the one or more illumination sources in the assembled lighting system. The controller may be configured to control at least one emission characteristic of the one or more illumination sources. The at least one emission characteristic may include, consist essentially of, or consist of a correlated color temperature, a color rendering index, R9, a luminous flux, a light output power, a spectral power density, a radiant flux, a light-distribution pattern, angular lumen intensity, and/or an angular color uniformity. The controller may include communication circuitry configured to transmit information to or from the assembled lighting system. The controller may be configured for wireless communication.

At least one illumination source may emit substantially white light. A correlated color temperature of the substantially white light may be in the range of 2000 K to 10,000 K. At least one illumination source may include, consist essentially of, or consist of a plurality of light-emitting elements. At least one light-emitting element may include, consist essentially of, or consist of a bare-die light-emitting diode. At least one light-emitting element may include, consist essentially of, or consist of a packaged light-emitting diode. At least one illumination source may include, consist essentially of, or consist of an organic light-emitting diode (OLED) source. At least one illumination source may include, consist essentially of, or consist of a flexible substrate and, disposed thereon, a plurality of light-emitting strings, each light-emitting string including, consisting essentially of, or consisting of a plurality of interconnected light-emitting elements spaced along the light-emitting string. The light-emitting elements of at least one light-emitting string may be separated by a substantially constant pitch. The at least one illumination source may include a plurality of control elements each (i) electrically connected to at least one light-emitting string and (ii) configured to control the current to the at least one light-emitting string to which it is electrically connected.

At least a portion of the packing container may have a transmittance greater than 25% to a wavelength of light emitted by the one or more illumination sources. At least a portion of an interior surface of the packing container and/or at least a portion of an exterior surface of the packing container may have a reflectance greater than 50% to a wavelength of light emitted by the one or more illumination sources. The packing container may include, consist essentially of, or consist of polyethylene naphthalate, polyethylene terephthalate, polycarbonate, polyethersulfone, polyester, polyimide, polyethylene, fiberglass, FR4, rubber, glass, cardboard, and/or paper. The packing container may have a substantially cylindrical shape. The packing container may define an opening through which the set of components are removed from the packing container. The packing container may include an end cap for occluding at least a portion of the opening. In the assembled lighting system, the power supply (and/or the controller) may be disposed within or on the end cap. The packing container may include or consist essentially of a shipping container having a shipping label disposed thereon.

In various embodiments, the set of components may include a controller that is electrically connected to the power supply and/or the one or more illumination sources in the assembled lighting system, the set of components may include a shade that is disposed at least partially around one or more of the illumination sources in the assembled lighting system, the shade may include, consist essentially of, or consist of a plurality of shade elements, each shade element (i) may be folded and/or deformed to fit within the packing container prior to removal therefrom and/or (ii) may include, consist essentially of, or consist of paper or plastic, the packing container may include, consist essentially of, or consist of cardboard and/or paper, the packing container (i) may define an opening through which the set of components are removed from the packing container and (ii) may include an end cap for occluding at least a portion of the opening, at least one illumination source may emit substantially white light, and at least one illumination source may include, consist essentially of, or consist of flexible substrate and, disposed thereon, a plurality of light-emitting strings, each light-emitting string including, consisting essentially of, or consisting of a plurality of interconnected light-emitting elements spaced along the light-emitting string.

In another aspect, embodiments of the invention feature a method of assembling a lighting system including or consisting essentially of a set of components initially disposed entirely within a packing container. The set of components includes or consists essentially of one or more illumination sources and a power supply. The components are removed from the packing container. An electrical connection between the power supply and the one or more illumination sources is provided. The finished lighting system is assembled by disposing the packing container at least partially around the one or more illumination sources such that, when the one or more illumination sources are illuminated, at least a portion of the light from the one or more illumination sources is transmitted and/or diffused by the packing container in the assembled lighting system during operation thereof.

Embodiments of the invention may include one or more of the following in any of a variety of combinations. The set of components may include a base. One or more (or even all) of the illumination sources may be disposed on the base, the base physically and stably supporting the one or more illumination sources in the assembled lighting system during operation thereof. One or more (or even all) of the illumination sources may be attached to an interior surface of the packing container, the packing container physically supporting the one or more said illumination sources in the assembled lighting system. The electrical connection between the power supply and the one or more illumination sources may be provided within the packing container before the components are removed therefrom. Providing the electrical connection between the power supply and the one or more illumination sources may include or consist essentially of connecting a cable between the power supply and at least one illumination source. The set of components may include a controller that is electrically connected to at least one of the power supply or the one or more illumination sources in the assembled lighting system. The controller may be configured to control at least one emission characteristic of one or more of the illumination sources. The at least one emission characteristic may include or consist essentially of a correlated color temperature, a color rendering index, R9, a luminous flux, a light output power, a spectral power density, a radiant flux, a light-distribution pattern, angular lumen intensity, and/or an angular color uniformity. The controller may include communication circuitry configured to transmit information to or from the assembled lighting system. The controller may be configured for wireless communication.

At least one illumination source may emit substantially white light. A correlated color temperature of the substantially white light may be in the range of 2000 K to 10,000 K. At least one illumination source may include or consist essentially of a plurality of light-emitting elements. At least one light-emitting element may include or consist essentially of a bare-die light-emitting diode. At least one light-emitting element may include or consist essentially of a packaged light-emitting diode. At least one light-emitting element may include or consist essentially of an organic light-emitting diode (OLED) source. At least one illumination source may include or consist essentially of a flexible substrate and, disposed thereon, a plurality of light-emitting strings, each light-emitting string including or consisting essentially of a plurality of interconnected light-emitting elements spaced along the light-emitting string. The light-emitting elements of at least one light-emitting string may be separated by a substantially constant pitch. The at least one illumination source may include a plurality of control elements each (i) electrically connected to at least one light-emitting string and (ii) configured to control the current to the at least one light-emitting string to which it is electrically connected.

At least a portion of the packing container may have a transmittance greater than 25% to a wavelength of light emitted by the one or more illumination sources. The packing container may include, consist essentially of, or consist of polyethylene naphthalate, polyethylene terephthalate, polycarbonate, polyethersulfone, polyester, polyimide, polyethylene, fiberglass, FR4, rubber, glass, cardboard, and/or paper. The packing container may have a substantially cylindrical shape. The packing container may define an opening through which the set of components are removed from the packing container, and the packing container may include an end cap for occluding at least a portion of the opening. In the assembled lighting system, the power supply (and/or the controller) may be disposed within or on the end cap. The packing container may include or consist essentially of a shipping container having a shipping label disposed thereon.

In various embodiments, the set of components may include a controller that is electrically connected to at least one of the power supply or the one or more illumination sources in the assembled lighting system, the packing container may include, consist essentially of, or consist of cardboard and/or paper, the packing container (i) may define an opening through which the set of components are removed from the packing container and (ii) may include an end cap for occluding at least a portion of the opening, at least one illumination source may emit substantially white light, and/or at least one illumination source may include or consist essentially of a flexible substrate and, disposed thereon, a plurality of light-emitting strings, each light-emitting string including or consisting essentially of a plurality of interconnected light-emitting elements spaced along the light-emitting string.

In yet another aspect, embodiments of the invention feature a lighting system that includes or consists essentially of a set of components and a packing container. The components are assemblable into the lighting system. The set of components includes or consists essentially of one or more illumination sources and a power supply for supplying power to the one or more illumination sources. Prior to assembly of the lighting system, the set of components fits entirely within the packing container. The packing container interfits with at least some of the components to form the assembled lighting system.

Embodiments of the invention may include one or more of the following in any of a variety of combinations. The packing container may physically and stably support the one or more illumination sources in the assembled lighting system during operation thereof. In the assembled lighting system, the packing container may be disposed at least partially around the one or more illumination sources such that, when the one or more illumination sources are illuminated, at least a portion of the light from the one or more illumination sources is transmitted and/or diffused by the packing container during operation of the assembled lighting system. One or more (or even all) of the illumination sources may be attached to an exterior surface of the packing container in the assembled lighting system. One or more (or even all) of the illumination sources may be attached to an interior surface of the packing container in the assembled lighting system. In the assembled lighting system, one or more of the illumination sources may be attached to the exterior surface of the packing container and one or more of the illumination sources may be attached to the interior surface of the packing container.

The set of components may include a shade disposed at least partially around one or more of the illumination sources in the assembled lighting system. The shade may include or consist essentially of a plurality of shade elements. Each shade element may fit within the packing container via folding and/or deformation. The shade elements may be stacked and/or at least partially interlocked together in the assembled lighting system. The shade may include, consist essentially of, or consist of polyethylene naphthalate, polyethylene terephthalate, polycarbonate, polyethersulfone, polyester, polyimide, polyethylene, fiberglass, FR4, fabric, rubber, paper, glass, and/or cardboard. At least a portion of the shade may have a transmittance greater than 25% to a wavelength of light emitted by the one or more illumination sources. At least a portion of an interior surface of the shade and/or at least a portion of an exterior surface of the shade may have a reflectance greater than 50% to a wavelength of light emitted by the one or more illumination sources.

The set of components may include a controller that is electrically connected to at least one of the power supply or the one or more illumination sources in the assembled lighting system. The controller may be configured to control at least one emission characteristic of the one or more illumination sources during operation of the assembled lighting system. The at least one emission characteristic may include or consist essentially of a correlated color temperature, a color rendering index, R9, a luminous flux, a light output power, a spectral power density, a radiant flux, a light-distribution pattern, angular lumen intensity, and/or an angular color uniformity. The controller may include communication circuitry for transmission of information to or from the assembled lighting system. The controller may be configured for wireless communication.

At least one illumination source may emit substantially white light. A correlated color temperature of the substantially white light may be in the range of 2000 K to 10,000 K. At least one illumination source may include or consist essentially of a plurality of light-emitting elements. At least one light-emitting element may include or consist essentially of a bare-die light-emitting diode. At least one light-emitting element may include or consist essentially of a packaged light-emitting diode. At least one light-emitting element may include or consist essentially of an organic light-emitting diode (OLED) source. At least one illumination source may include or consist essentially of a flexible substrate and, disposed thereon, a plurality of light-emitting strings, each light-emitting string including or consisting essentially of a plurality of interconnected light-emitting elements spaced along the light-emitting string. The light-emitting elements of at least one light-emitting string may be separated by a substantially constant pitch. The at least one illumination source may include a plurality of control elements each (i) electrically connected to at least one light-emitting string and (ii) configured to control the current to the at least one light-emitting string to which it is electrically connected.

At least a portion of the packing container may have a transmittance greater than 25% to a wavelength of light emitted by the one or more illumination sources. At least a portion of an interior surface of the packing container and/or at least a portion of an exterior surface of the packing container may have a reflectance greater than 50% to a wavelength of light emitted by the one or more illumination sources. The packing container may include, consist essentially of, or consist of polyethylene naphthalate, polyethylene terephthalate, polycarbonate, polyethersulfone, polyester, polyimide, polyethylene, fiberglass, FR4, rubber, glass, cardboard, and/or paper. The packing container may have a substantially cylindrical shape. The packing container may define an opening through which the set of components may be removed from the packing container. The packing container may include an end cap for occluding at least a portion of the opening. The power supply (and/or the controller) may be disposed within or on the end cap in the assembled lighting system. The packing container may include or consist essentially of a shipping container having a shipping label disposed thereon.

In various embodiments, the set of components may include a controller that is electrically connected to at least one of the power supply or the one or more illumination sources, the set of components may include a shade that is disposed at least partially around one or more of the illumination sources in the assembled lighting system, the shade may include or consist essentially of a plurality of shade elements, each shade element may fit within the packing container via folding and/or deformation, each shade element may include, consist essentially of, or consist of paper and/or plastic, the packing container may include, consist essentially of, or consist of cardboard and/or paper, the packing container may define an opening through which the set of components may be removed from the packing container and include an end cap for occluding at least a portion of the opening, at least one illumination source may emit substantially white light, and at least one illumination source may include or consist essentially of a flexible substrate and, disposed thereon, a plurality of light-emitting strings, each light-emitting string including or consisting essentially of a plurality of interconnected light-emitting elements spaced along the light-emitting string.

These and other objects, along with advantages and features of the invention, will become more apparent through reference to the following description, the accompanying drawings, and the claims. Furthermore, it is to be understood that the features of the various embodiments described herein are not mutually exclusive and can exist in various combinations and permutations. Reference throughout this specification to "one example," "an example," "one embodiment," or "an embodiment" means that a particular feature, structure, or characteristic described in connection with the example is included in at least one example of the present technology. Thus, the occurrences of the phrases "in one example," "in an example," "one embodiment," or "an embodiment" in various places throughout this specification are not necessarily all referring to the same example. Furthermore, the particular features, structures, routines, steps, or characteristics may be combined in any suitable manner in one or more examples of the technology. As used herein, the terms "about," "approximately," and "substantially" mean±10%, and in some embodiments, ±5%. The term "consists essentially of" means excluding other materials that contribute to function, unless otherwise defined herein. Nonetheless, such other materials may be present, collectively or individually, in trace amounts.

Herein, two components such as light-emitting elements and/or optical elements being "aligned" or "associated" with each other may refer to such components being mechanically and/or optically aligned. By "mechanically aligned" is meant coaxial or situated along a parallel axis. By "optically aligned" is meant that at least some light (or other electromagnetic signal) emitted by or passing through one component passes through and/or is emitted by the other.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

Figure 1A:
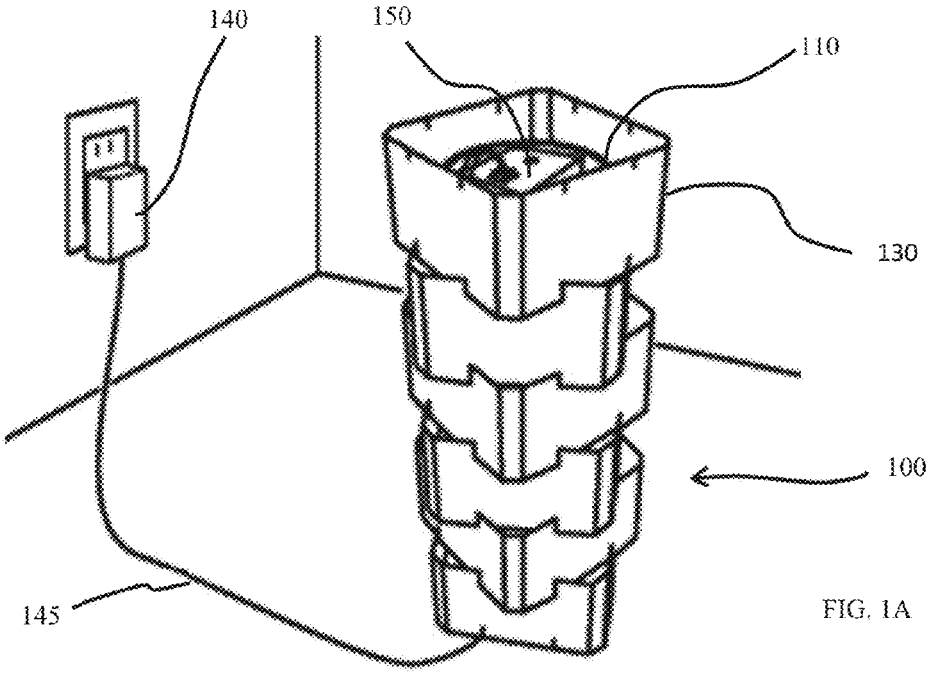
FIG. 1A is a schematic of an assembled lighting device in accordance with various embodiments of the invention.
Figure 1B:
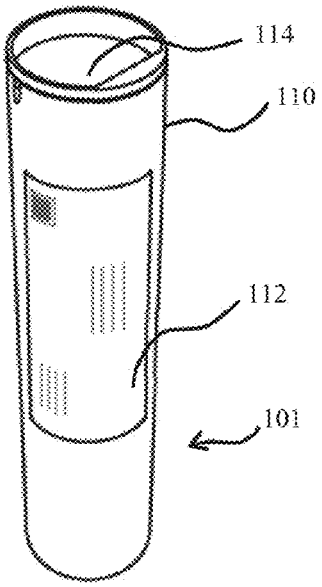
FIG. 1B is a schematic of a packaged lighting device in accordance with various embodiments of the invention.

FIGS. 1A and 1B depict an exemplary lighting device configured for use and as packed, respectively, in accordance with embodiments of the present invention. FIG. 1A shows a lighting device 100 configured for use and including or consisting essentially of a packing container 110, a light sheet (not shown in FIG. 1A), a diffuser or shade 130, a power supply 140, a controller 150, and a cable 145 electrically connecting power supply 140 to controller 150. FIG. 1B shows the lighting device of FIG. 1A in packaged form. All of the components are packaged within a package 101, which may include the packing container 110, an optional shipping label 112 (e.g., if packing container 110 is to be used for shipping itself rather than placed within a different shipping container), and one or more end caps 114.

FIG. 1B shows packing container 110 having a substantially cylindrical shape having a circular cross-section; however, this is not a limitation of the present invention, and in other embodiments of the present invention packing container 110 may have a square, rectangular, hexagonal, octagonal, or other cross section. In some embodiments of the present invention, packing container 110 may have a substantially cubic shape or may have a rectangular prism shape or may have any shape. FIG. 1B shows one end cap 114; however, this is not a limitation of the present invention, and in other embodiments packing container 110 may have an end cap 114 on both ends of packing container 110. In other embodiments of the present invention in which packing container 110 has a different shape, end caps 114 corresponding to the specific shape of the packing container 110 may be employed, or packing container 110 may have no end caps 114. In some embodiments of the present invention, optional shipping label 112 may be removed when packing container 110 is configured for use, while in other embodiments shipping label 112 may be left on packing container 110. In some embodiments of the present invention, the contents of shipping label 112 may be printed directly on packing container 110, while in other embodiments no shipping label 112 may be utilized. In some embodiments of the present invention, all of the components required to configure lighting device 100 for use are contained within the package 101.

In some embodiments, the packing container 110 may include or consist essentially of paper; however, this is not a limitation of the present invention, and in other embodiments packing container 110 may include or consist essentially of one or more other materials, for example plastic, polyethylene naphthalate (PEN), polyethylene terephthalate (PET), polycarbonate, polyethersulfone, polyester, polyimide, polyethylene, fiberglass, FR4, rubber, glass, cardboard, or the like.

Figure 2:
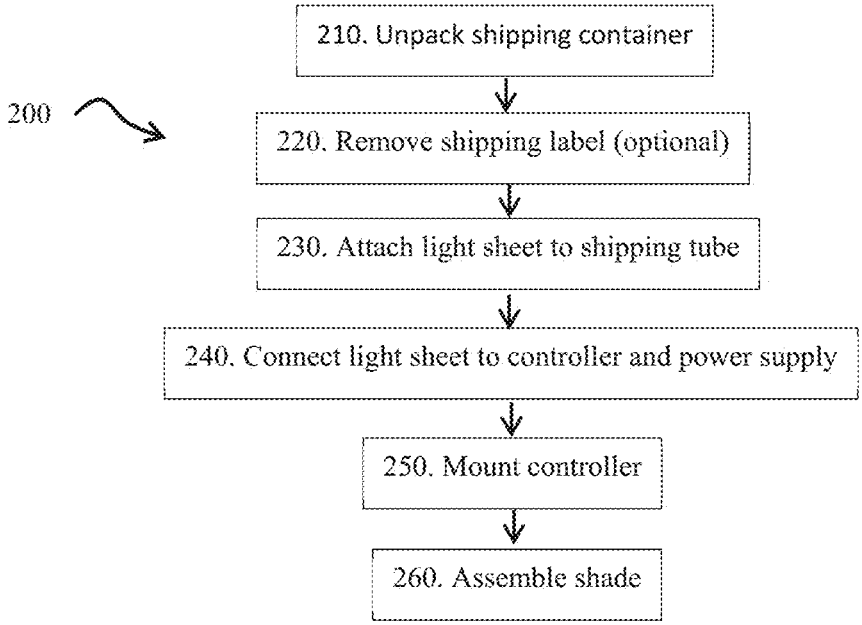
FIG. 2 is a flowchart of a method of assembling a lighting device in accordance with various embodiments of the invention.

FIG. 2 is a flow chart of a process 200 for configuring the lighting device 100 for use. Process 200 is shown having six steps; however, this is not a limitation of the present invention, and in other embodiments the process has more or fewer steps and/or the steps may be performed in different order. In step 210, the contents of the package are removed from the package. In optional step 220, the shipping label, if utilized, is removed. In step 230, the light sheet is attached to the packing container. In step 240, the light sheet is connected to the controller and power supply. In step 250, the controller is mounted. In step 260, the shade or diffuser is assembled. Various approaches to these processes and structures are discussed below.

Figure 3A:
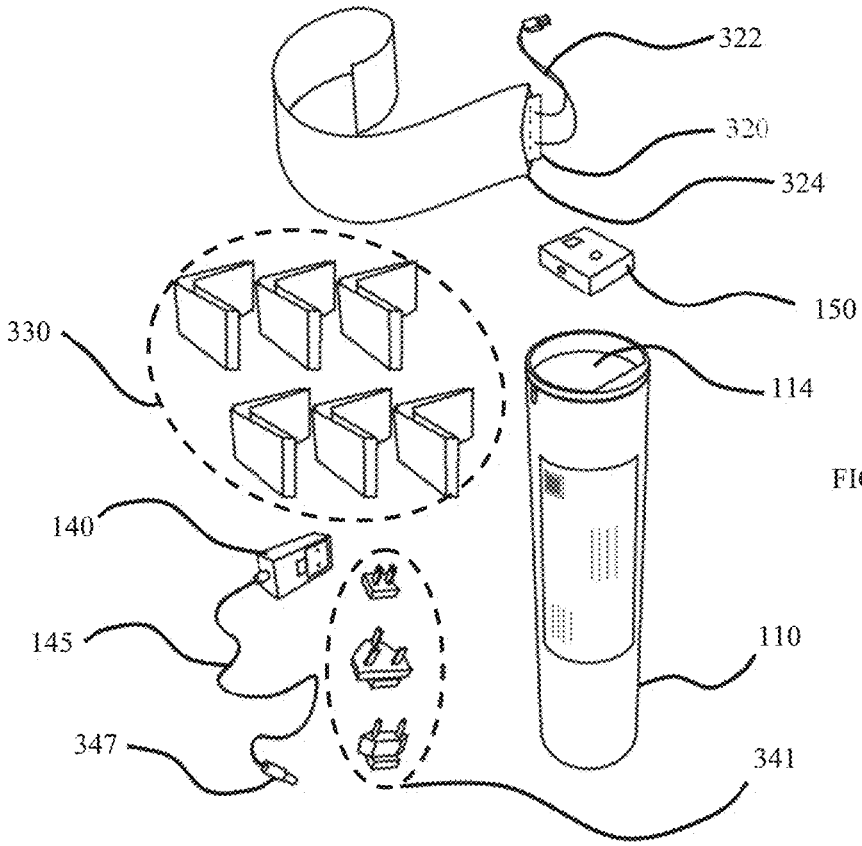
FIGS. 3A-3K are schematics showing the assembly of lighting devices in accordance with various embodiments of the invention.

FIG. 3A shows an example of the lighting system after step 210 of process 200. In this exemplary embodiment of the invention, the contents of package 101 include shade or diffuser 330 (which may include or consist essentially of one or multiple parts), power supply 140, cable 145, a connector 347, power supply plugs 341, controller 150, and a light sheet 320 that includes a wiring harness 322 disposed inside a sleeve 324. In some embodiments of the present invention, shade or diffuser 330 is disassembled, as shown in FIG. 3A, and must be assembled to form, e.g., shade or diffuser 130 in FIG. 1A; however, this is not a limitation of the present invention, and in other embodiments shade or diffuser 130 may not require assembly before mounting in or on the lighting device. In some embodiments of the present invention, power supply 140 may include provision for one or more plug 341 (which may be interchangeable), such that power supply 140 may be plugged directly into an outlet, for example an AC mains outlet. In the example shown in FIG. 3A, plugs 341 are separable from power supply 140, permitting different plugs for different geographical regions to be mounted on a universal power supply 140; however, this is not a limitation of the present invention, and in other embodiments plug 341 may not be configurable and may be a permanent part of power supply 140. In some embodiments of the present invention, connector 347 may be used to connect power supply 140 to controller 150. In some embodiments of the present invention, light sheet 320 includes wiring harness 322 that mates to controller 150. In some embodiments of the present invention, light sheet 320 is shipped in a protective sleeve 324. In some embodiments of the present invention, protective sleeve 324 may provide protection against electrostatic discharge (ESD), protection from physical damage, or the like.

In optional step 220, shipping label 112, if used, is removed from packing container 110. However, as discussed herein, this is not a limitation of the present invention, and in other embodiments label 112 may remain in place, or the contents of label 112 may be printed on packing container 110 and not be removable. In some embodiments of the present invention, an optional sleeve, not shown in FIG. 3A, may be disposed over all or a portion of packing container 110. The optional sleeve may be colored or contain a design and may be used to cover packing container 110. In some embodiments of the present invention, the packing container 110 is substantially opaque, while in other embodiments the packing container 110 is translucent or even substantially transparent.

Figure 3B:
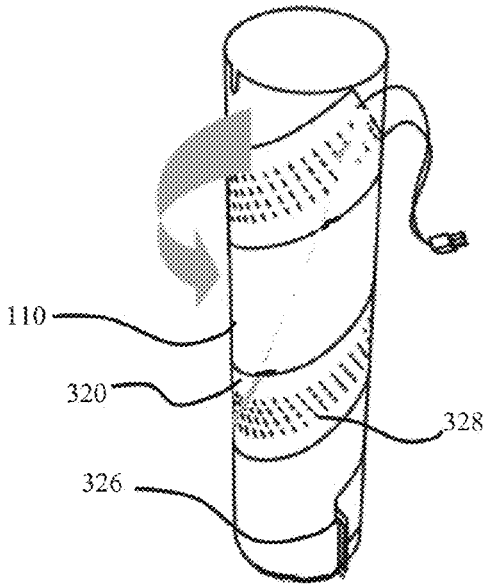
Figure 3C:
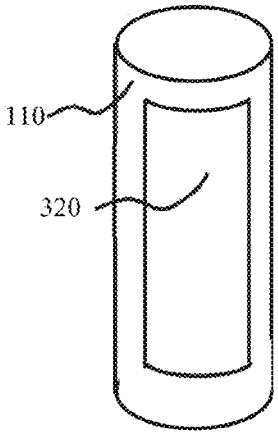
Figure 3D:
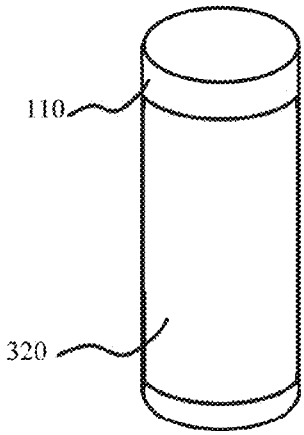
Figure 3E:
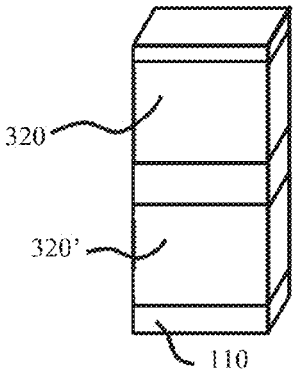

In step 230, light sheet 320 is attached to packing container 110. As shown in FIG. 3B, light sheet 320 typically includes an array of LEEs 328. If used, the protective liner 324 is first removed from light sheet 320. In some embodiments of the present invention, light sheet 320 is wrapped around packing container 110, as shown for example in FIG. 3B. While FIG. 3B shows light sheet 320 wrapping in a helical, non-overlapping fashion around packing container 110, this is not a limitation of the present invention, and in other embodiments light sheet 320 may be disposed around packing container 110 in different configurations. For example, in some embodiments of the present invention, the light sheet 320 may be may be disposed on packing container 110 in a vertical strip, as shown in FIG. 3C, or wrapped completely or partially around packing container 110 in a cylindrical fashion, as shown in FIG. 3D. Some embodiments of the present invention may include or consist essentially of more than one light sheet 320; for example, FIG. 3E shows an embodiment of the present invention including two light sheets 320 and 320'. FIG. 3E also shows packing container 110 having a rectangular cross-section.

Referring back to FIG. 3B, light sheet 320 may be affixed or adhered to packing container 110 using a variety of means, for example tape or adhesive 326, a hook and loop fastener such as Velcro, by mechanical means, for example stapling, riveting, punching, or the like. In preferred embodiments of the present invention, an adhesive for attaching light sheet 320 to packing container 110 is pre-attached to all or portions of the back of light sheet 320 or to portions of packing container 110. In some embodiments, a removable liner may be initially disposed over the adhesive or tape, and the liner is removed prior to attaching light sheet 320 to packing container 110. The adhesive or other fastener may also be included within the packing container with the other components of the lighting system during shipping.

Figure 3F:
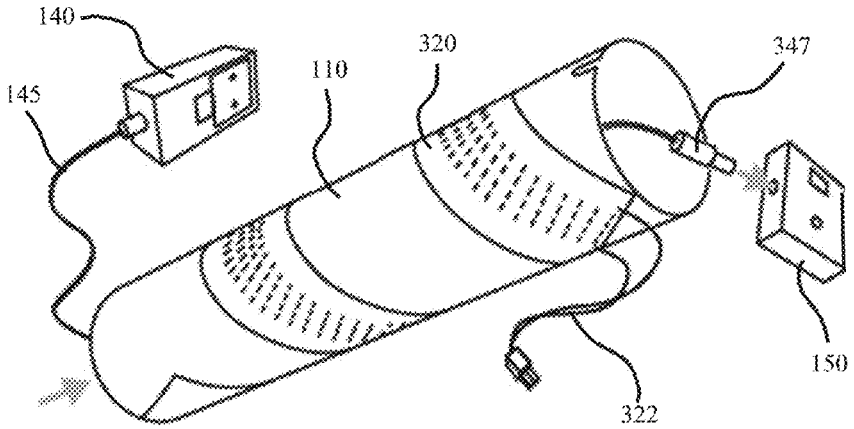
Figure 3G:
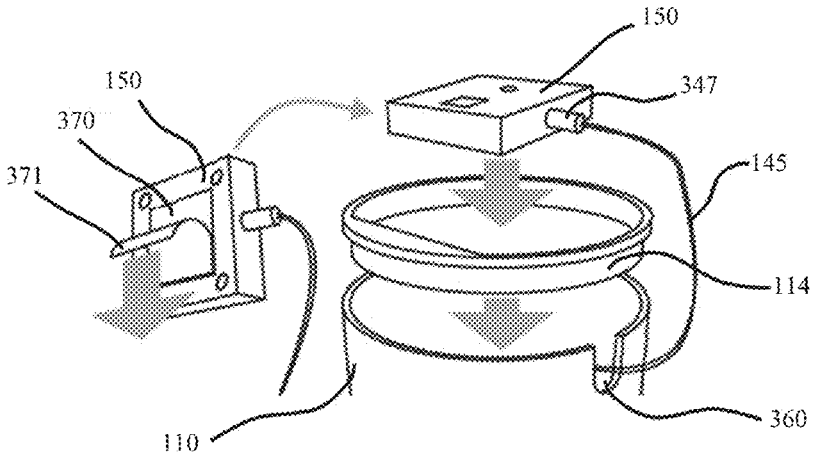

In step 240, the light sheet 320 is connected to the power supply 140 and controller 150. In some embodiments, as shown in FIG. 3F, cable 145 is threaded through packing container 110 and connected to controller 150; however, this is not a limitation of the present invention, and in other embodiments other configurations may be utilized to connect controller 150 to power supply 140. In some embodiments, controller 150 may be not be a separate component and may instead be included within power supply 140, while in other embodiments power supply 140 may be included within controller 150. FIG. 3G illustrates the mounting of controller 150 in accordance with an embodiment of the present invention. In this embodiment, end cap 114 is mounted on the end of packing container 110, and controller 150 is mounted in or on end cap 114. In some embodiments of the present invention, tape or adhesive 370 is pre-attached to end cap 114 or controller 150 (as shown in FIG. 3G) and is used to affix controller 150 to end cap 114. In some embodiments, a liner 371 is disposed over tape or adhesive 370 and is removed prior to mounting of controller 150 on end cap 114. In some embodiments of the present invention, the packing container defines a notch 360 to accommodate cable 145—for example to permit cable 145 to exit from the interior of packing container 110 to connect to controller 150.

Figure 3H:
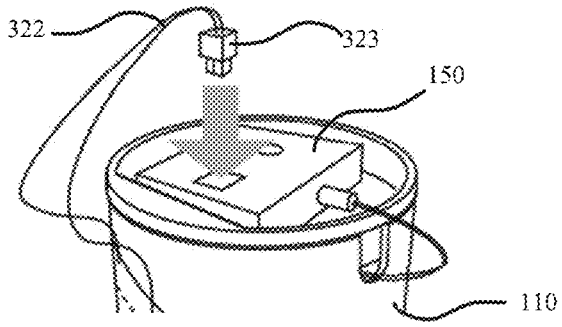

Wiring harness 322 of light sheet 320 is then connected to the controller 150, for example using a connector 323 as shown in FIG. 3H. FIGS. 3G and 3H show one exemplary configuration of controller 150 mounted to packing container 110; however, this is not a limitation of the present invention, and in other embodiments controller 150 may be mounted using different means or mounted in a different location. For example, in one embodiment of the present invention, controller 150 may be mounted in the other end (bottom) of packing container 110, or may be separate from packing container 110 or may be part of power supply 140 or may be omitted.

While FIG. 3A shows packing container 110 having a cylindrical shape with two open ends that are closed by end caps 114, this is not a limitation of the present invention, and in other embodiments packing container 110 may employ other means for closure, for example one or more flaps on packing container 110, tape, fabric, enclosure in another package (for example a shipping bag or package), enclosure in a bag, or the like.

In step 260, the shade or diffuser is assembled and mounted to the rest of the lighting system. In the embodiments shown in FIGS. 3I-3K, the shade 130 includes or consists essentially of multiple shade elements 330. In some embodiments of the present invention, one or more of the shade elements 330 are bent, folded, and/or otherwise deformed into a form more amenable to fitting inside packing container 110, as shown by shade element 330' in FIG. 3I. In such embodiments, shade element 330' is unfolded to produce shade element 330, and then shade elements 330 are assembled together to form shade 130, as shown in FIG. 3J. As shown in FIG. 3K, the completed shade 130 is then positioned over the packing container 110 to complete assembly of lighting system 100, shown in its assembled form in FIG. 1A. In some embodiments of the present invention, shade elements 330 may include one or more cuts 331 to permit shade portions 330 to be assembled by sliding the cut regions of adjacent shade portions 330 together, as shown in region 333 of FIG. 3J.

Figure 3I:
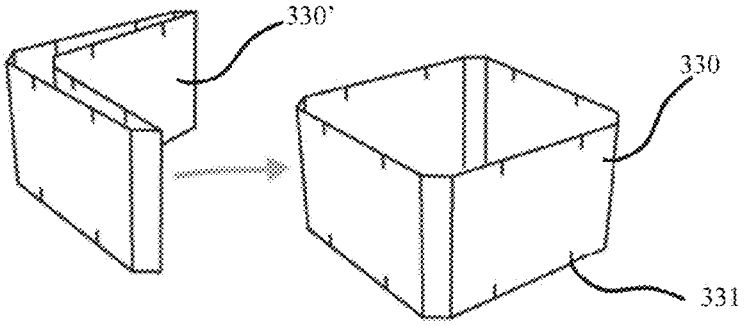
Figure 3J:
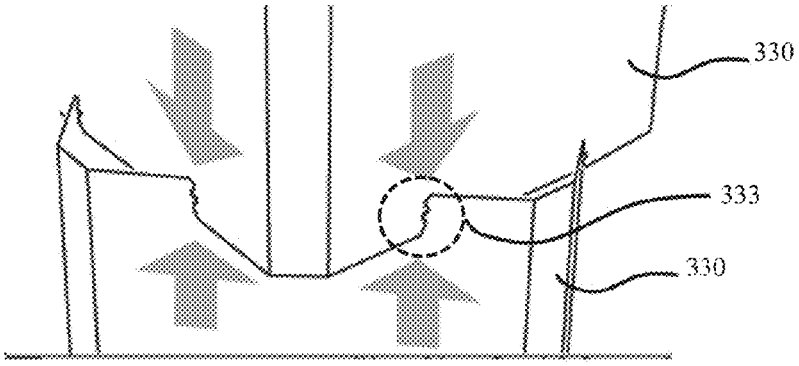
Figure 3K:
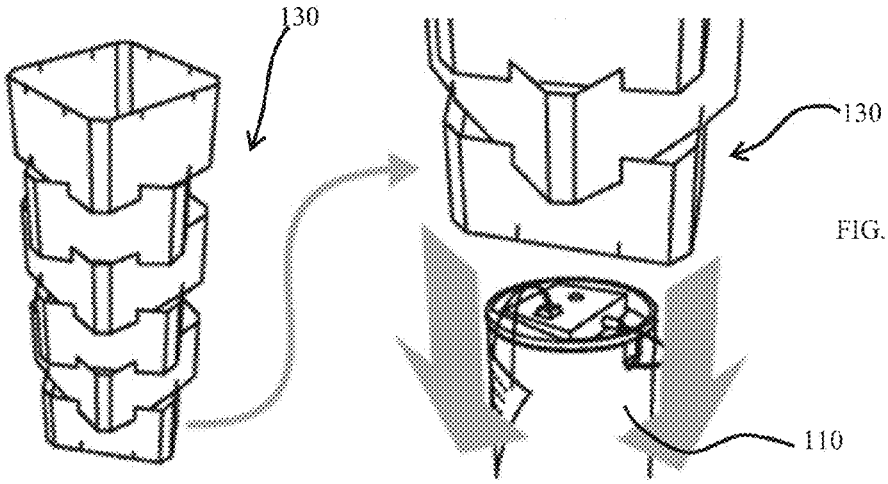

While FIG. 3I shows a folded shade element 330', this is not a limitation of the present invention, and in other embodiments one or more of the shade elements 330 may not be folded in packing container 110. While FIGS. 3I-3K show multiple shade elements 330 making up shade 130, this is not a limitation of the present invention, and in other embodiments shade 130 may include or consist essentially of only one piece or portion. While FIG. 3I shows each shade element 330 as having a substantially square cross-section, this is not a limitation of the present invention, and in other embodiments shade elements 330 may have a circular, triangular, hexagonal, or octagonal cross-section, or may have any arbitrary or free-form cross-section. In some embodiments of the invention, different shade elements 330 have different cross-sectional shapes and/or sizes. In some embodiments, shade element 330 and/or shade 130 may include or consist essentially of paper; however, this is not a limitation of the present invention, and in other embodiments shade element 330 and/or shade 130 may include or consist essentially of other materials, for example plastic, polyethylene naphthalate (PEN), polyethylene terephthalate (PET), polycarbonate, polyethersulfone, polyester, polyimide, polyethylene, fiberglass, FR4, fabric, rubber, glass, cardboard, or the like.

In some embodiments of the present invention, shade 130 may include or consist essentially of a fabric, which may be stretched or wrapped around light sheet 320 and packing container 110. In some embodiments of the present invention, an optional frame may be utilized to space shade 130 apart from light sheet 320. In some embodiments of the present invention, shade 130 may permit visualization of individual LEEs on light sheet 320, while in other embodiments shade 130 may diffuse the light emitted by light sheet 320 such that individual LEEs on light sheet 320 are not distinguishable and the light appears to be substantially homogeneous light.

Figure 4:
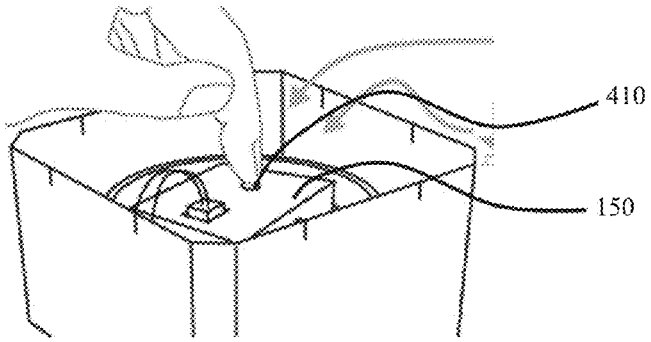
FIGS. 4-8 are schematics of lighting devices in accordance with various embodiments of the invention.

In some embodiments of the present invention, controller 150 may include a power switch (i.e., an on/off switch) to energize or de-energize the light sheet 320. In some embodiments of the present invention, controller 150 may provide dimming capability—that is, the ability to change the intensity of light emitted by light sheet 320, for example by reducing the current or voltage to light sheet 320 or by modulation of the power to light sheet 320. In some embodiments of the present invention, controller 150 may include a button or actuator 410, for example as shown in FIG. 4, that may be utilized to energize and de-energize lighting system 100 and/or that may permit dimming of lighting system 100. For example, the actuator 410 may be a rotating dial or a sliding switch enabling the selection of a desired dimming level from a series of different dimming levels. In some embodiments of the present invention, controller 150 may change other characteristics of the illumination system, for example correlated color temperature (CCT), color rendering index (CRI), R9, luminous flux, light output power, spectral power density, radiant flux, light distribution pattern, angular color uniformity, angular lumen intensity, or the like. In some embodiments of the present invention, controller 150 may be actuated manually by one or more switches that are part of controller 150, for example actuator 410 in FIG. 4; however, this is not a limitation of the present invention, and in other embodiments controller 150 may be actuated or interfaced with without physical contact, for example wirelessly, for example using a radio- or light-based communication system or remote control. For example, in some embodiments, controller 150 may be actuated and/or interfaced with by WI-FI, Bluetooth, ZiGbee, light-based communication, or the like. The means of controlling and/or interfacing with controller 150 is not a limitation of the present invention.

In some embodiments, the controller 150, and thus the lighting system 100, may be controlled via a smartphone. A smartphone is a mobile phone with advanced computing ability that, generally, facilitates bi-directional communication and data transfer. Smartphones include, for example, IPHONES (available from Apple Inc., Cupertino, Calif.), BLACKBERRY devices (available from RIM, Waterloo, Ontario, Canada), or any mobile phones equipped with the ANDROID platform (available from Google Inc., Mountain View, Calif.). The smartphone may communicate with the lighting system 100 using a connection already built into the phone, such as a Wi-Fi, Bluetooth, or near-field communication (NFC) connection. Alternatively, a smartphone dongle may be used to customize the data-transfer protocol between the smartphone and the lighting system 100, which facilitates optimizing the sender and/or receiver components of the controller 150, e.g., for reduced power consumption, and may provide a layer of security beyond that available through the smartphone. A smartphone dongle is a special hardware component, typically equipped with a microcontroller, designed to mate with a corresponding connector on the smartphone (e.g., a Mini USB connector or the proprietary iPhone connector). The connector may accommodate several power and signal lines (including, e.g., serial or parallel ports) to facilitate communication between the dongle and the smartphone and to power the dongle via the phone.

In certain embodiments, the smartphone and lighting system 100 communicate over a (uni- or bi-directional) infrared (IR) link, which may utilize one or more inexpensive IR light-emitting diodes and phototransistors as transmitters and receivers, respectively. Data transfer via the IR link may be based on a protocol with error detection or error correction on the receiving end. A suitable protocol is the IrDA standard for IR data communication, which is well-established and easy to implement. Communication between the lighting system 100 and the smartphone may also occur at radio frequencies (RF), using, e.g., a copper antenna as the transmitter/receiver component. The transmitter/receiver and associated circuitry, which may be portions of the controller 150, may be powered by the power supply 140 and/or by the signal transmitted from the smartphone or other communication device. In some embodiments, the communication module and/or other portions of controller 150 remains in a dormant state until "woken up" by an external signal, thereby conserving power.

In some embodiments, the smartphone is used to send real-time signals to the lighting system 100, for example, to turn the light sheet 320 on or off, or to adjust the light output of light sheet 320 (e.g., via dimming). The communication link between the smartphone and the lighting system 100 may be unidirectional (typically allowing signals only to be sent from the phone and received by the lighting system) or bi-directional (facilitating, e.g., transmission of status information from the lighting system 100 to be sent to the smartphone). A special software application (e.g., an iPhone "app") executing as a running process on the smartphone may provide a user interface for controlling the lighting system 100 via the smartphone display. As a security measure, the application may be configured to be accessible only when a dongle is connected to the smartphone.

Figure 5:
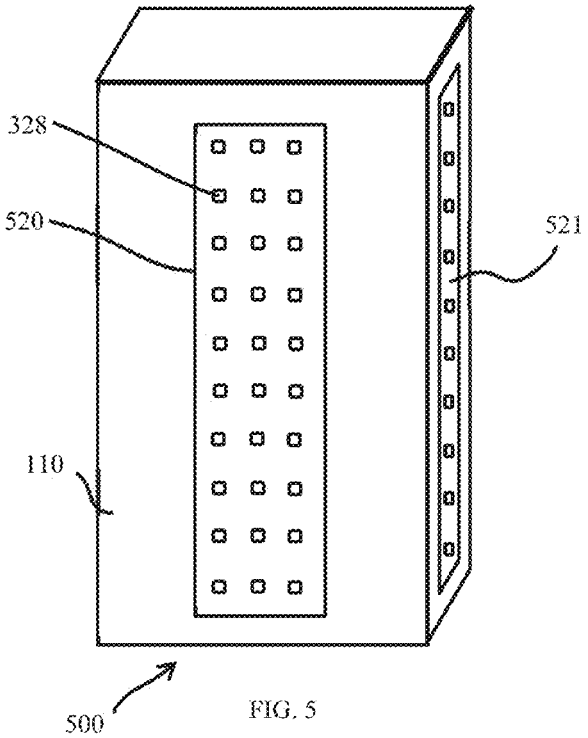

FIG. 5 shows an exemplary lighting device 500 in accordance with various embodiments of the present invention. As shown, lighting device includes packing container 110 having a rectangular prismatic shape and two light strips 520 and 521. Other elements of lighting system 500 (for example power supply, controller, cables, etc.) are not shown for clarity. In some embodiments, light strip 520 may be a flexible light sheet; however, this is not a limitation of the present invention, and in other embodiments light strip 520 may include or consist essentially of a flexible or semi-rigid or rigid printed circuit board on which are formed an array (e.g., a two-dimensional array) of LEEs 328. While light strip 520 has a square periodic array of LEEs 328, this is not a limitation of the present invention, and in other embodiments LEEs 328 may be formed in arrays having different geometries, for example triangular, pentagonal, hexagonal, or in any regular periodic pattern or any random or arbitrary pattern. Lighting device 500 also includes light strip 521, which is different from light strip 520. In the example shown in FIG. 5, light strip 521 includes or consists essentially of a one-dimensional array of LEEs 328. In some embodiments, light strip 521 may include or consist essentially of light tape, LED tape, light sheet, flexible, semi-rigid or rigid printed circuit boards or the like. While FIG. 5 shows two different light strips 520 and 521 as part of lighting device 500, this is not a limitation of the present invention, and in other embodiments lighting device 500 may have only one type of light strip or may have three or more different types of light strips.

In some embodiments of the present invention, a lighting device may have an illumination source, for example a light sheet or light strip, on all exterior faces of packing container 110; however, this is not a limitation of the present invention, and in other embodiments one or more faces or portions of packing container 110 may not be populated with an illumination source.

Figure 6:
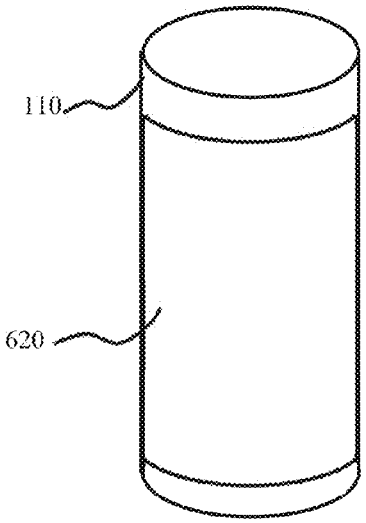

FIG. 6 shows an embodiment of the present invention that includes or consists essentially of an OLED illumination source 620 disposed around packing container 110. While the structure of FIG. 6 shows OLED illumination source 620 disposed around the entire circumference of packing container 110, this is not a limitation of the present invention, and in other embodiments OLED illumination source 620 may only be formed around a portion of the circumference of packing container 110, or more than one OLED illumination source 620 may be formed on the surface of packing container 110.

Figure 7:
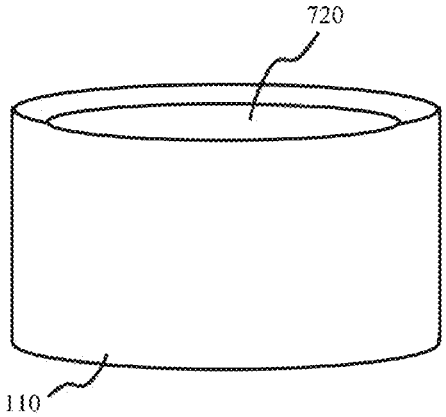

While the structures of FIGS. 1A-6 show the illumination source disposed or mounted on the external surface of packing container 110, this is not a limitation of the present invention, and in other embodiments all or a portion of (e.g., one or more of multiple different sources) the illumination source may be formed on all or a portion of the interior of packing container 110, for example as shown in FIG. 7 in which a light sheet 720 is formed on the interior surface of packing container 110. In some embodiments of the present invention, the illumination source may be formed on all or substantially all of the interior surface of packing container 110, while in other embodiments one or more illumination sources may be formed on one or more portions of the interior surface of packing container 110.

Figure 8:
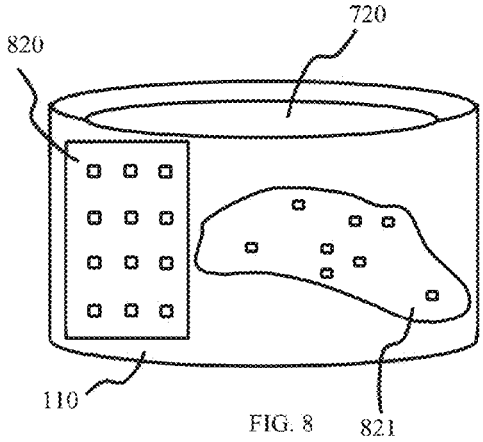

In some embodiments of the present invention, one or more illumination sources may be formed on both the interior and exterior surfaces of packing container 110, for example as shown in FIG. 8. FIG. 8 shows an embodiment of the present invention that includes or consists essentially of illumination source 720 in the interior surface of packing container 110 and two illumination sources 820 and 821 on the exterior surfaces of packing container 110.

In some embodiments of the present invention, the illumination source, for example a light sheet or light strip, has a rectangular or substantially rectangular shape; however, this is not a limitation of the present invention, and in other embodiments the illumination source may have a different shape, for example triangular, pentagonal, square, hexagonal, octagonal or any arbitrary or free-form shape. For example, illumination source 821 in FIG. 8 has a free-form, irregular shape. In some embodiments of the present invention, all LEEs of the lighting device may be the same; however, this is not a limitation of the present invention, and in other embodiments a lighting device may include different LEEs, for example LEEs having a different light output power, CCT, CRI, spectral power distribution, angular power density, angular color uniformity, or the like.

In some embodiments of the present invention, all or a portion of packing container 110 may be reflective to a wavelength of light emitted by the LEEs. In some embodiments of the present invention, all or a portion of the surface of packing container 110 may have a reflectance greater than 50% or greater than 75% to a wavelength of light emitted by the LEE. In some embodiments of the present invention all or a portion of packing container 110 may be transparent or partially transparent to a wavelength of light emitted by the LEE. In some embodiments of the present invention all or a portion of the surface of packing container 110 may have a transmittance greater than 25% or greater than 50% or greater than 75% to a wavelength of light emitted by the LEE.

In some embodiments of the present invention all or a portion of shade 130 may be reflective to a wavelength of light emitted by the LEE. In some embodiments of the present invention all or a portion of the surface of shade 130 may have a reflectance greater than 50% or greater than 75% to a wavelength of light emitted by the LEEs. In some embodiments of the present invention, all or a portion of shade 130 may be transparent or partially transparent to a wavelength of light emitted by the LEEs. In some embodiments of the present invention, all or a portion of the surface of shade 130 may have a transmittance greater than 25% or greater than 50% or greater than 75% to a wavelength of light emitted by the LEEs.

In one embodiment of the present invention, a lighting device may include a transparent or partially transparent packing container 110, i.e., one that is transparent, partially transparent or diffusing to a wavelength of light emitted by one or more LEEs on the illumination source, and the illumination source is mounted on all or a portion of the interior surface of packing container 110.

Figure 9A:
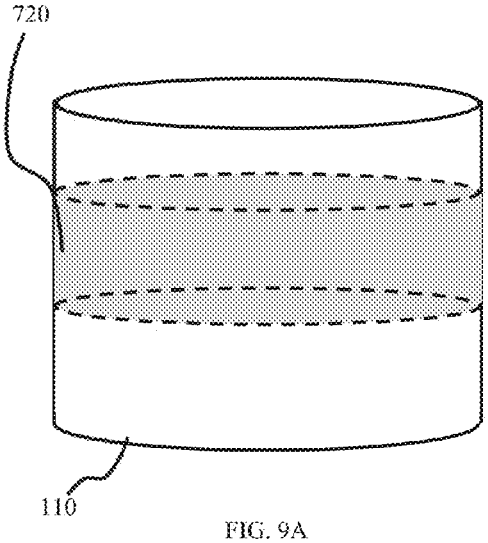
FIGS. 9A-9D are schematics of lighting devices in accordance with various embodiments of the invention.

While the lighting systems described in reference to FIGS. 1A and 3B and other figures herein utilize packing container 110 as a support the illumination source, this is not a limitation of the present invention, and in other embodiments packing container 110 may serve other functions in the lighting system, for example as a shade, a base, a support for the power supply, a support for the controller or the like. In some embodiments of the present invention, packing container 110 may serve multiple functions. For example, FIG. 9A shows an embodiment of the present invention having illumination source 720 disposed on a portion of the interior surface of the packing container 110. In this embodiment, there is no separate shade, and packing container 110 acts as the shade. In some embodiments, the packing container 110 is opaque or substantially opaque to a wavelength of light emitted by illumination source 720; however, this is not a limitation of the present invention, and in other embodiments packing container 110 may be transparent or partially transparent (for example translucent) to a wavelength of light emitted by illumination source 720.

Figure 9B:
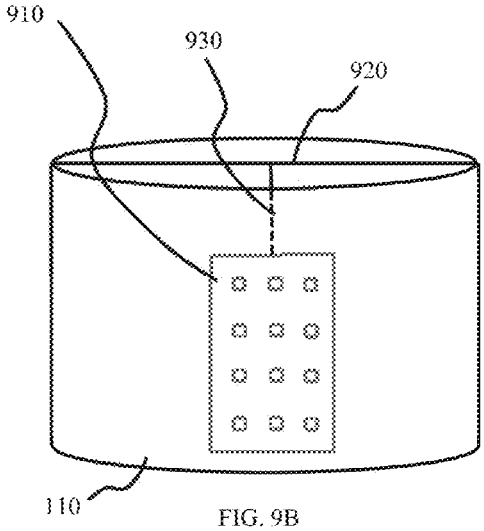

FIG. 9B shows an embodiment of the present invention featuring an illumination source 910 disposed within the interior of packing container 110. In this embodiment, illumination source 910 is suspended from a cross-piece 920 by a connector 903 (e.g., a cable, string, or a wire); however, this is not a limitation of the present invention, and in other embodiments the illumination source 910 may be positioned within packing container by other means, for example suspended from an end cap, standing on the surface on which packing container 110 is standing, positioned within packing container 110 by a mounting bracket or frame or the like, any of which would be disposed within the packing container 110 prior to assembly of the lighting system. In the embodiment of FIG. 9B, there is no separate shade, and packing container 110 acts as the shade. In some embodiments, packing container 110 is opaque or substantially opaque to a wavelength of light emitted by illumination source 910; however, this is not a limitation of the present invention, and in other embodiments packing container 110 may be transparent or partially transparent (for example translucent) to a wavelength of light emitted by illumination source 910. While the example shown in FIG. 9B shows illumination source 910 as a flat sheet, this is not a limitation of the present invention, and in other embodiments illumination source 910 may be curved or formed into a cylinder or may have any shape. In some embodiments of the present invention, illumination source 910 may include or consist essentially of two light sheet elements disposed back-to-back within packing container 110 acting as a shade for the light sheets.

Figure 9C:
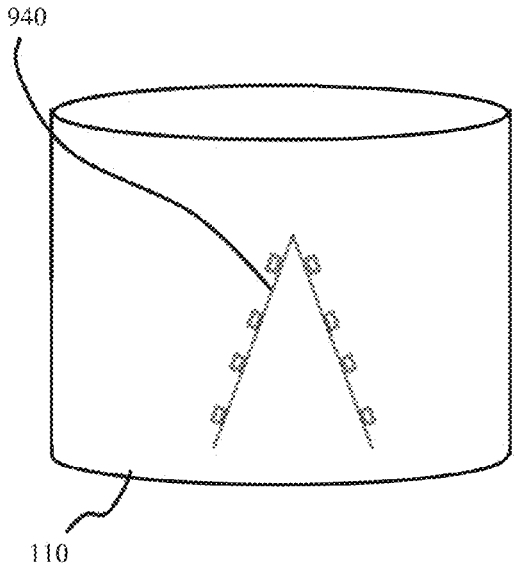
Figure 9D:
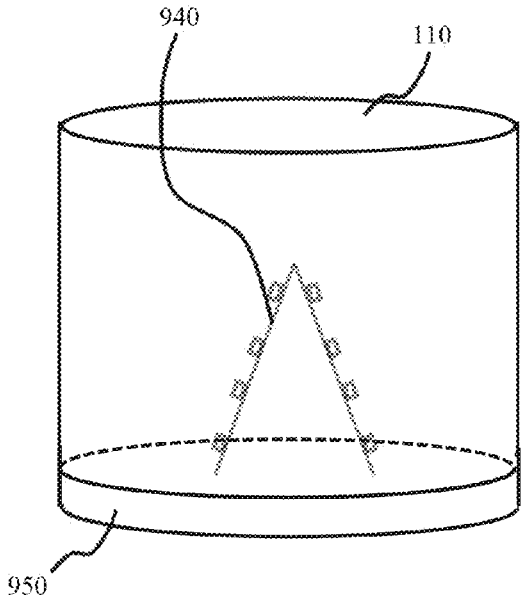

FIG. 9C shows an embodiment of the present invention featuring an illumination source 940 positioned in a self-supporting manner within packing container 110. In the embodiment shown in FIG. 9C, illumination source 940 includes or consists essentially of two elements forming a self-supporting inverted-V or tent shape; however, this is not a limitation of the present invention, and in other embodiments illumination source 940 may be in the form of a cone, cylinder, partial cube, or any other shape. In some embodiments of the present invention, an end cap may be positioned on the bottom of packing container 110 and illumination source 940 may be disposed on the end cap and/or partially or substantially supported by the end cap. For example, FIG. 9D shows an embodiment of the present invention that includes a base 950 that is supporting packing container 110 and illumination source 940. In some embodiments of the present invention, base 950 may include or consist essentially of an end cap; however, this is not a limitation of the present invention, and in other embodiments base 950 may be a component separate from and different than any end cap(s) and may be provided or packed inside packing container 110 prior to assembly of the lighting system.

As utilized herein, the term "light-emitting element" (LEE) refers to any device that emits electromagnetic radiation within a wavelength regime of interest, for example, visible, infrared or ultraviolet regime, when activated, by applying a potential difference across the device or passing a current through the device. Examples of light-emitting elements include solid-state, organic, polymer, phosphor-coated or high-flux LEDs, laser diodes or other similar devices as would be readily understood. The emitted radiation of an LEE may be visible, such as red, blue or green, or invisible, such as infrared or ultraviolet. An LEE may produce radiation of a continuous or discontinuous spread of wavelengths. An LEE may feature a phosphorescent or fluorescent material, also known as a light-conversion material, for converting a portion of its emissions from one set of wavelengths to another. In some embodiments, the light from an LEE includes or consists essentially of a combination of light directly emitted by the LEE and light emitted by an adjacent or surrounding light-conversion material. An LEE may include multiple LEEs, each emitting essentially the same or different wavelengths. In some embodiments, a LEE is an LED that may feature a reflector over all or a portion of its surface upon which electrical contacts are positioned. The reflector may also be formed over all or a portion of the contacts themselves. In some embodiments, the contacts are themselves reflective. Herein "reflective" is defined as having a reflectivity greater than 65% for a wavelength of light emitted by the LEE on which the contacts are disposed. In some embodiments, an LEE may include or consist essentially of an electronic device or circuit or a passive device or circuit. In some embodiments, an LEE includes or consists essentially of multiple devices, for example an LED and a Zener diode for static-electricity protection. In some embodiments, an LEE may include or consist essentially of a packaged LED, i.e., a bare LED die encased or partially encased in a package. In some embodiments, the packaged LED may also include a light-conversion material. In some embodiments, the light from the LEE may include or consist essentially of light emitted only by the light-conversion material, while in other embodiments the light from the LEE may include or consist essentially of a combination of light emitted from an LED and from the light-conversion material. In some embodiments, the light from the LEE may include or consist essentially of light emitted only by an LED.

One or more non-LEE devices such as Zener diodes, transient voltage suppressors (TVSs), varistors, etc., may be placed on each light sheet to protect the LEEs from damage that may be caused by high-voltage events, such as electrostatic discharge (ESD) or lightning strikes.

In one embodiment, an LEE includes or consists essentially of a bare semiconductor die, while in other embodiments LEE includes or consists essentially of a packaged LED.

In some embodiments, an LEE may include or consist essentially of a "white die" that includes an that is integrated with a light-conversion material (e.g., a phosphor) before being attached to the light sheet, as described in U.S. patent application Ser. No. 13/748,864, filed Jan. 24, 2013, or U.S. patent application Ser. No. 13/949,543, filed Jul. 24, 2013, the entire disclosure of each of which is incorporated by reference herein.

In some embodiments, LEEs may emit light in a relatively small wavelength range, for example having a full width at half maximum in the range of about 20 nm to about 200 nm. In some embodiments, all LEEs may emit light of the same or substantially the same wavelength, while in other embodiments different LEEs 140 may emit light of different wavelengths. In some embodiments, LEEs may emit white light, for example that is perceived as white light by the eye. In some embodiments, the white light may be visible light with a spectral power distribution the chromaticity of which is close to the blackbody locus in the CIE 1931 xy or similar color space. In some embodiments, white light has a color temperature in the range of about 2000 K to about 10,000 K. The emission wavelength, full width at half maximum (FWHM) of the emitted light or radiation or other optical characteristics of LEEs 140 may not be all the same and are not a limitation of the present invention.

Advantageously, embodiments of the present invention utilize a light sheet having controlled optical characteristics. In some embodiments of the present invention it is advantageous to have multiple light sheets, each of which as a similar CCT, preferably the average CCT of each light sheet during manufacture or use having a relatively narrow CCT distribution. One measure of white color temperature is defined as a MacAdam ellipse. A MacAdam ellipse represents a region of colors on a chromaticity chart, for example the CIE chromaticity diagram, and a one-step MacAdam ellipse represents the range of colors around the center of the ellipse that are indistinguishable to the average human eye, from the color at the center of the ellipse. The contour of a one-step MacAdam ellipse therefore represents barely noticeable differences of chromaticity.

Multiple-step MacAdam ellipses may be constructed that encompass larger ranges of color around the center point. While there are many recommendations as to how tight the color temperature uniformity should be (as measured by MacAdam ellipses or other units), a variation encompassed within a smaller step number of MacAdam ellipses (smaller ellipse) is more uniform than one encompassed within a larger step number of MacAdam ellipses (larger ellipse). For example, a four-step MacAdam ellipse encompasses about a 300K color temperature variation along the black body locus, centered at 3200K, while a two-step MacAdam ellipse encompasses about a 150K color temperature variation along the black body locus, centered at 3200K.

In some embodiments of the present invention, the variation in average CCT between different light sheets is less than 4 MacAdam ellipses, or less than 3 MacAdam ellipses or less than 2 MacAdam ellipses.

In general in the above discussion the arrays of semiconductor dies, light emitting elements, optics, and the like have been shown as square or rectangular arrays; however this is not a limitation of the present invention and in other embodiments these elements may be formed in other types of arrays, for example hexagonal, triangular or any arbitrary array. In some embodiments these elements may be grouped into different types of arrays on a single substrate.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A lighting system comprising:

a set of components comprising one or more illumination sources and a power supply for supplying power to the one or more illumination sources, the components being assemblable into the lighting system; and a packing container, wherein (i) prior to assembly of the lighting system, the set of components fits entirely within the packing container, and (ii) the packing container interfits with at least some of the components to form the assembled lighting system.

2. The lighting system of claim 1, wherein the packing container physically and stably supports the one or more illumination sources in the assembled lighting system during operation thereof.

3. The lighting system of claim 1, wherein, in the assembled lighting system, the packing container is disposed at least partially around the one or more illumination sources such that, when the one or more illumination sources are illuminated, at least a portion of the light from the one or more illumination sources is transmitted and/or diffused by the packing container during operation of the assembled lighting system.

4. The lighting system of claim 1, wherein one or more of the illumination sources are attached to an exterior surface of the packing container in the assembled lighting system.

5. The lighting system of claim 4, wherein one or more of the illumination sources are attached to an interior surface of the packing container in the assembled lighting system.

6. The lighting system of claim 1, wherein one or more of the illumination sources are attached to an interior surface of the packing container in the assembled lighting system.

7. The lighting system of claim 1, wherein the set of components comprises a shade disposed at least partially around one or more of the illumination sources in the assembled lighting system.

8. The lighting system of claim 7, wherein (i) the shade comprises a plurality of shade elements, (ii) each shade element fits within the packing container via folding and/or deformation, and (iii) the shade elements are stacked and/or at least partially interlocked together in the assembled lighting system.

9. The lighting system of claim 7, wherein the shade comprises at least one of polyethylene naphthalate, polyethylene terephthalate, polycarbonate, polyethersulfone, polyester, polyimide, polyethylene, fiberglass, FR4, fabric, rubber, paper, glass, or cardboard.

10. The lighting system of claim 7, wherein at least a portion of the shade has a transmittance greater than 25% to a wavelength of light emitted by the one or more illumination sources.

11. The lighting system of claim 7, wherein at least a portion of an interior surface of the shade and/or at least a portion of an exterior surface of the shade has a reflectance greater than 50% to a wavelength of light emitted by the one or more illumination sources.

12. The lighting system of claim 1, wherein the set of components comprises a controller that is electrically connected to at least one of the power supply or the one or more illumination sources in the assembled lighting system.

13. The lighting system of claim 12, wherein the controller is configured to control at least one emission characteristic of the one or more illumination sources during operation of the assembled lighting system.

14. The lighting system of claim 1, wherein at least one illumination source emits substantially white light.

15. The lighting system of claim 14, wherein a correlated color temperature of the substantially white light is in the range of 2000 K to 10,000 K.

16. The lighting system of claim 1, wherein at least one illumination source comprises a plurality of light-emitting elements.

17. The lighting system of claim 16, wherein at least one light-emitting element comprises a bare-die light-emitting diode.

18. The lighting system of claim 1, wherein at least one illumination source comprises a flexible substrate and, disposed thereon, a plurality of light-emitting strings, each light-emitting string comprising a plurality of interconnected light-emitting elements spaced along the light-emitting string.

19. The lighting system of claim 18, wherein the at least one illumination source comprises a plurality of control elements each (i) electrically connected to at least one light-emitting string and (ii) configured to control the current to the at least one light-emitting string to which it is electrically connected.

20. The lighting system of claim 1, wherein at least a portion of the packing container has a transmittance greater than 25% to a wavelength of light emitted by the one or more illumination sources.

21. The lighting system of claim 1, wherein at least a portion of an interior surface of the packing container and/or at least a portion of an exterior surface of the packing container has a reflectance greater than 50% to a wavelength of light emitted by the one or more illumination sources.

22. The lighting system of claim 1, wherein:

the set of components comprises a controller that is electrically connected to at least one of the power supply or the one or more illumination sources;

the set of components comprises a shade that is disposed at least partially around one or more of the illumination sources in the assembled lighting system;

the shade comprises a plurality of shade elements, each shade element (i) fitting within the packing container via folding and/or deformation and (ii) comprising paper or plastic;

the packing container comprises cardboard or paper;

the packing container (i) defines an opening through which the set of components may be removed from the packing container and (ii) comprises an end cap for occluding at least a portion of the opening;

at least one illumination source emits substantially white light; and at least one illumination source comprises a flexible substrate and, disposed thereon, a plurality of light-emitting strings, each light-emitting string comprising a plurality of interconnected light-emitting elements spaced along the light-emitting string.

* * * * *